United States Patent [19]

Seager

[11] 4,440,303

[45] Apr. 3, 1984

[54] TRAY

[75] Inventor: Richard H. Seager, Mystic, Conn.

[73] Assignee: King-Seeley Thermos Co., Norwich, Conn.

[21] Appl. No.: 321,418

[22] Filed: Nov. 16, 1981

[51] Int. Cl.[3] ..... B65D 21/02

[52] U.S. Cl. ..... 206/509; 206/511; 206/545; 220/4 D; 220/23.6; 220/20

[58] Field of Search ..... 220/4 C, 4 D, 23.6, 220/20; 206/545, 509, 511, 541, 549; 217/25, 26, 26.5, 27

[56] References Cited

U.S. PATENT DOCUMENTS

| | | | |
|---|---|---|---|
| 3,191,791 | 6/1965 | Jackson | 217/25.5 |
| 3,283,891 | 11/1966 | English | 217/27 |
| 3,346,137 | 10/1967 | Ricci | 206/511 |
| 3,532,247 | 10/1970 | Bridges | 206/545 |
| 3,908,852 | 9/1975 | Ricobene | 220/4 D |
| 4,014,450 | 3/1977 | Girotti | 220/4 B |

*Primary Examiner*—George E. Lowrance

*Attorney, Agent, or Firm*—Harness, Dickey & Pierce

[57] ABSTRACT

An improved insulated tray having both of its top and bottom surfaces configured so that either may receive food articles. In addition, the configuration is such that the trays may be stacked one upon the other in a wide variety of configurations. When so stacked, the depressions in the upper tray serve to provide a closure for the depressions in the lower tray.

1 Claim, 6 Drawing Figures

TRAY

BACKGROUND OF THE INVENTION

This invention relates to an insulated tray and more particularly to an improved insulated tray that offers a wide variety of stacking capabilities and which may be used either in an upright or inverted condition.

Insulated trays are used for a variety of purposes. Such trays are widely used in institutional applications. Normally in such applications, the service consists of a tray and a separate cover for the tray. Such two-piece assemblies obviously are more expensive than a single piece unit and present handling problems. Although it has been proposed to provide a configuration for a tray wherein the trays may be stacked one upon the other without the use of covers, such unitary assemblies have not been wholly satisfactory and have suffered from lack of versitility.

It is, therefore, a principal object of this invention to provide an insulated tray having improved stacking characteristics.

It is another object of the invention to provide an improved stacking, insulated tray wherein adjacent trays may be stacked one upon the other in a wide variety of orientations.

It is still a further object of this invention to provide an insulated tray which may be used in an upright or in an inverted condition.

SUMMARY OF THE INVENTION

This invention is adapted to be embodied in an insulated tray having spaced upper and lower surfaces. The upper surface of the tray is formed with depressions for receipt of food articles. Interlocking means are formed both on the upper surface and lower surface of the tray. The interlocking means are configured so that pairs of trays may be stacked one upon the other and interlocked against relative transverse movement. The interlocking means are further configured so that pairs of trays may be stacked with either tray inverted relative to the other, with both trays upright or with both trays inverted.

Another feature of the invention is also adapted to be embodied in an insulated tray having spaced upper and lower surfaces. In accordance with this feature of the invention, each surface of the tray is formed with depressions so that either surface may receive food articles or the like.

DETAILED DESCRIPTION OF THE PREFERRED EMBODIMENT

Figure 1:
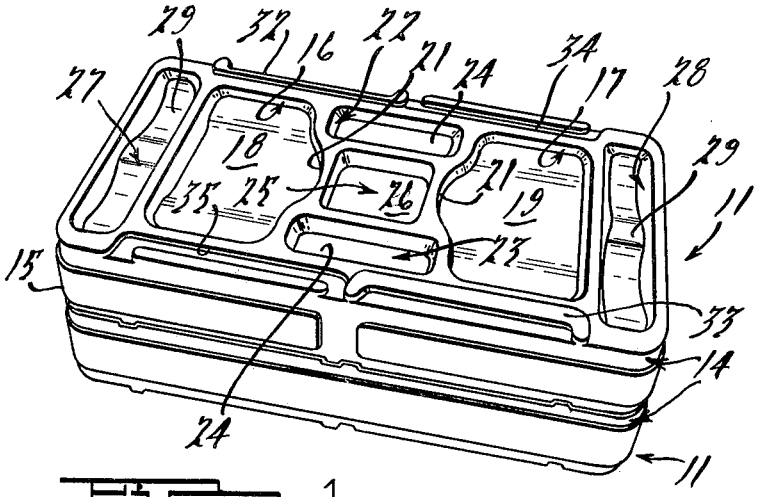
FIG. 1 is a perspective view showing two trays constructed in accordance with the invention stacked one upon the other.
Figure 4:
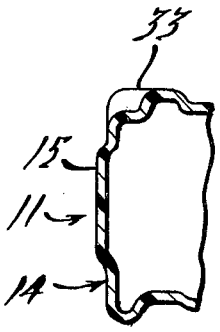
FIG. 4 is a cross-sectional view taken along the line 4—4 of FIG. 2.
Figure 5:
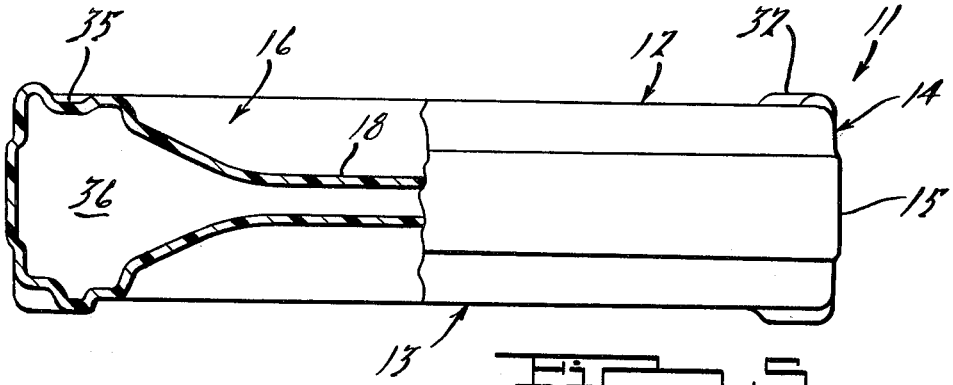
FIG. 5 is a cross-sectional view taken along the line 5—5 of FIG. 2.
Figure 6:
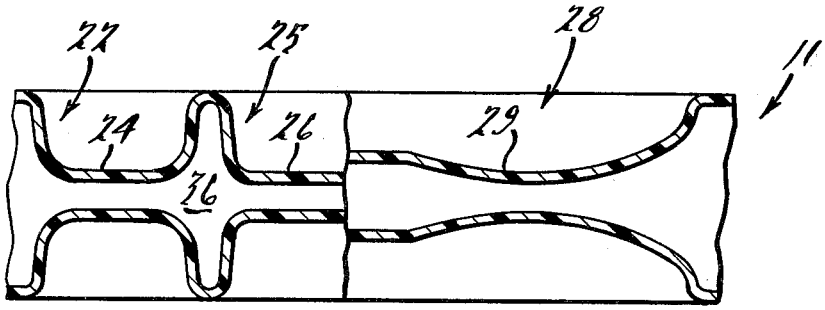
FIG. 6 is a cross-sectional view taken along the line 6—6 of FIG. 2.

An insulated tray constructed in accordance with this invention is identified generally by the reference numeral 11. As will become apparent, the construction of the tray 11 is such that trays may be stacked one upon the other in a wide variety of orientations. As will also become apparent, the trays 11 are configured in such a way that regardless of how the opposite surfaces of the trays are oriented, and regardless of how the trays are stacked, they will always appear the same.

Each tray 11 is formed primarily of a unitary assembly from plastic or any other similar molded material. The tray 11 has opposite surfaces, indicated generally by the reference numerals 12 and 13, one of which may be considered an upper surface and the other of which may be considered the lower surface. As noted, the surfaces 12 and 13 are configured so that regardless of which of these surfaces forms the upper surface in actual use, and regardless of the orientation of the tray about a vertical axis passing through the center of the tray, the appearance will be the same. The upper and lower surfaces 12 and 13 are joined by a peripheral surface, indicated generally by the reference numeral 14. The peripheral surface 14 is generally plainer but has a raised central portion 15 that extends along the full length of the sides and continuously along the full length of one of the long sides. The raised portion 15 is, however, interrupted in the center of the opposite long side as clearly shown in FIGS. 1 and 3. In FIG. 1 the uppermost tray shows the interruption at one of the long sides, whereas the lowermost tray 11 is rotated 180 degrees and shows the uninterrupted extent of the raised portion 15 along the opposite long side. The extension of the raised potion 15 along the short sides serves to provide a handle whereby the tray 11 may be conveniently lifted.

The upper surface 13 is formed with a series of depressions for receipt of food articles as will be described. These depressions comprise a pair of large depressions 16 and 17 that have planer lower surfaces 18 and 19 respectively and have a generally rectangular configuration except for a curved surface 21 that is formed adjacent the center line of the surface 12. As should be readily apparent from an inspection of the figures, the depressions 18 and 19 are symmetrical about a vertical plane extending through the mid point of the surface 12 and parallel to the sides of the tray 11. The depressions 16 and 17 are large enough to receive such things as plates, bowls, or the like. Also, food such as bread, sandwiches, hamburgers, or the like, may be positioned in the depressions 16 and 17.

A pair of smaller generally rectangular depressions 22 and 23, which also have planer lower walls 24, are formed between the non-curved portions of the depressions 16 and 17. The depressions 22 and 23 are symmetrical about vertical planes passing through the center of the tray 11 and parallel to the both of the short sides and long sides of the tray. The depressions 22 and 23 may hold complementary shaped plates or directly receive things such as vegetables, salads, or the like.

A generally square depression 25 is formed between the depressions 22 and 23 and the curved walls 21 of the depressions 16 and 17. The depression 25 also has a planer lower wall 26 and is symmetrical about vertical planes passing through the center of the tray and parallel to both the long and short sides of the tray. The center cavity 25 may hold cake, cookies, or the like.

A pair of side depressions 27 and 28 of generally rectangular configuration in plane view are formed along the outer sides of the tray surface 12 adjacent the short sides of the peripheral wall 14. The depressions 27 and 28 have a lower wall 29 which is formed with a raised potion 31 that extends across the center of each of the depressions 27 and 28 so as to provide a slight division between pockets formed by the raised portions 31. The side cavities 27 and 28 may hold flatware, condiments, or the like.

The surface 12 is also formed with interlocking means which permit the trays 11 to be stacked upon each other and held against transverse movement. The interlocking means consists of a pair of raised projections 32 and 33 formed in diagonally opposite quadrants of the surface 12. The projections 32 and 33 have a generally "U" shape as viewed in plane, as clearly shown in FIG. 2. Corresponding shaped recesses or depressions 34 and 35 are formed in the opposite quadrants of the surface 12. The recesses 34 and 35 are configured to receive the raised projections 32 and 33.

Figures 2, 3:
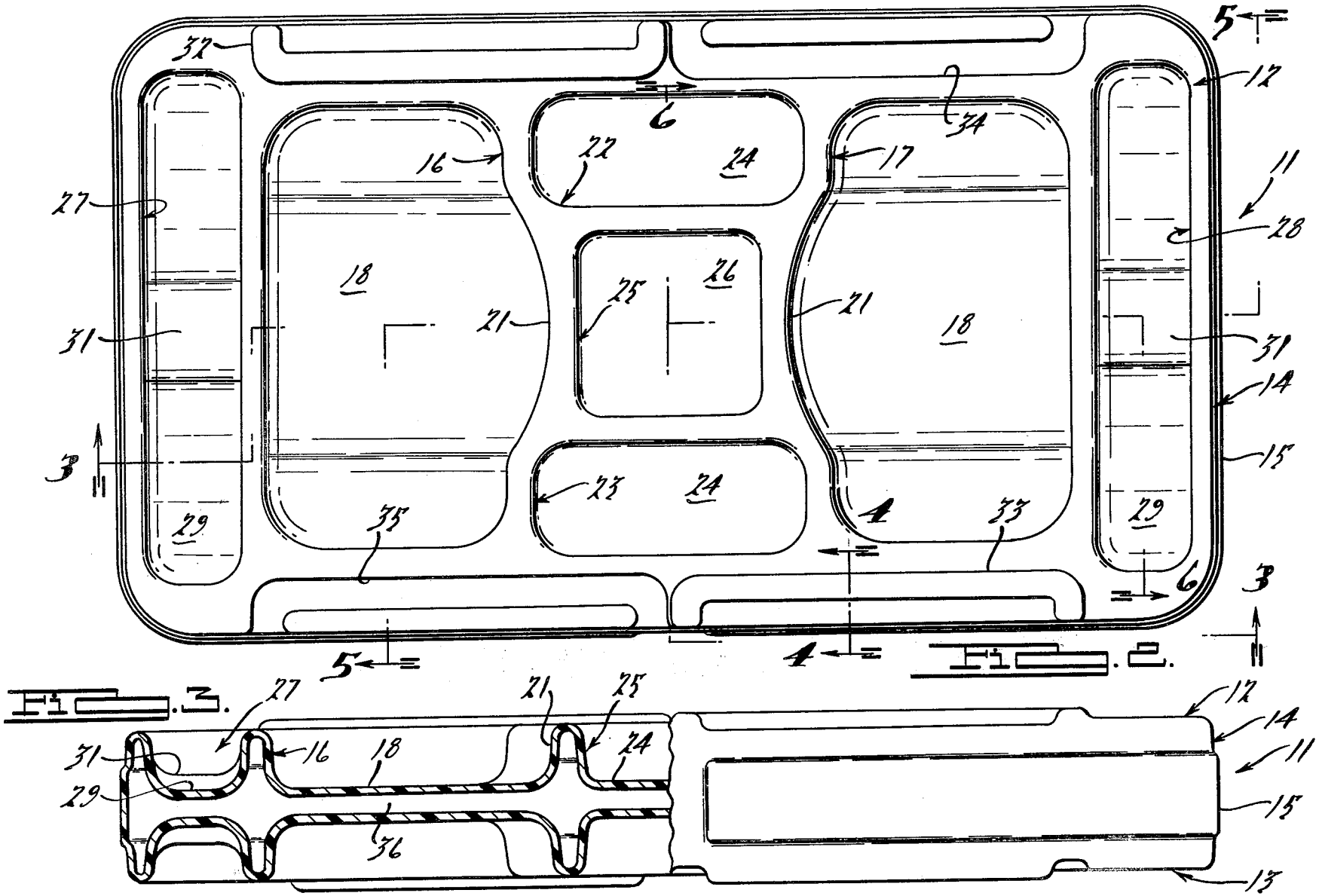
FIG. 2 is an enlarged top plan view of one of the trays shown in FIG. 1.
FIG. 3 is a cross-sectional view taken along the line 3—3 of FIG. 2.

The lower surface 13 is formed with depressions to receive food articles of identical configuration to the top surface depressions 16, 17, 22, 23, 25, 27 and 28. That is, if the tray were inverted from the position shown in FIG. 2 so that the surface 13 would form the top surface, the appearance would be identical to that of FIG. 2. The only difference which would appear between a figure drawn showing such inversion would be that the interruption of the raised portion 15 of the peripheral wall 14 would appear at the top of such an inverted figure rather than at the bottom as shown in FIG. 2. In a like manner, the surface 13 is formed with raised portions identical to the top surface portions 32 and 33 and depressions identical to the depressions 34 and 35. An inverted view showing the surface 13 in plane would also be identical as to the appearance of these projections and depressions as previously described with respect to FIG. 2. Again considering FIG. 2 in plane and showing the top surface 12, the bottom surface 13 would have its depression corresponding to the top surface depression 35 positioned directly under the top surface projection 32. In a like manner, the bottom surface projection corresponding to the top surface projection 33 lies directly under the top surface recess 34. As a result, the stacking arrangements described below are possible.

Trays 11 may be stacked one upon the other with their top surface 12 all facing upwardly. When so stacked, the projections and depressions in the lower surface 13 will co-act with the projections 32 and 33 and depressions 34 and 35 of the top surface 12 so as to interlock the trays one upon the other. When so interlocked, the trays will be held against transverse movement relative to each other. Also, the recesses formed in the lower surface 13 would correspond to the upper surface recesses 16, 17, 22, 23, 25, 27 and 28 and will overlie these upper surface recesses so as to form a clearance area above the articles in these upper surface recesses.

It is also possible to stack trays 11 on each other with each tray inverted relative to the next adjacent tray. When this is done, the recesses of the lower surface 13, which correspond to the upper surface recesses 34 and 35, will overlie the projections 32 and 33 of the adjacent tray upper surface 12 and vice versa so as to provide the aforenoted interlocking relationship. Again, due to the symmetry of the food receiving cavities 16, 17, 22, 23, 25, 27 and 28 about a vertical plane passing through the center of the tray, the cavities in the lower surface 13 are formed closer with clearance for the corresponding cavities of the tray's upper surface 12.

In addition to the aforenoted stacking capabilities, the trays 11 may be stacked one upon the other when the trays are rotated 180 degrees from the orientation shown in FIG. 2. This stacking is also possible regardless of whether the surface 12 or the surface 13 faces upwardly. This stacking capability is also possible due to the symmetry about the aforedescribed vertically extending planes.

As shown in the cross-sectional views, FIGS. 3, 4, 5 and 6, the lower walls 18, 24, 26 and 29 of the various food receiving depressions of the upper surface 12 are spaced from the corresponding depression of the lower surface 13 so as to provide an insulation volume 36 between the surfaces 12 and 13. This insulation volume may be either left open or may be filled with a suitable insulating material as desired.

It should be readily apparent from the foregoing description that a tray configuration has been provided which permits a wide variety of stacking orientations of one tray relative to the others. This permits greater versatility in the use of the trays. Although a specific configuration for food receiving recesses has been described, it is obvious that a wide variety of configurations may be employed. Various other changes and modifications may also be made without departing from the spirit and scope of the invention, as defined by the appended claims.

I claim:

1. An insulated tray having spaced upper and lower surfaces, said upper and lower surfaces being formed with a plurality of different shaped depression means therein for receipt of food articles or the like, said depressions including a pair of elongated depressions each extending along one side of said upper surface substantially between opposite marginal edges, said elongated depressions each having the same configuration, said depressions on said upper surface and said lower surface being configured to present the same appearance regardless of which surface faces upwardly and regardless of which said of the exposed surfaces lies to the right of the viewer, interlocking means formed on said upper surface, and interlocking means formed on said lower surface, said interlocking means comprising only a relatively shallow recess and a complimentary relatively low projection formed adjacent each other on each of the marginal edges of each of said tray surfaces, said recesses and said projections lying on opposite quadrants of the respective tray surfaces, said recesses and said projections having a U-shape in plan, said upper and lower surface interlocking means being configured so that pairs of said trays may be stacked one upon the other and interlocked against relative transverse movement, said interlock means being further configured so that the pairs of trays may be stacked with either tray inverted relative to the other with both trays upright, or with both trays inverted.

* * * * *